US009171531B2

(12) United States Patent
David

(10) Patent No.: US 9,171,531 B2
(45) Date of Patent: Oct. 27, 2015

(54) DEVICE AND METHOD FOR INTERPRETING MUSICAL GESTURES

(75) Inventor: Dominique David, Claix (FR)

(73) Assignees: Commissariat À L'Energie et aux Energies Alternatives, Paris (FR); Movea SA, Grenoble (FR)

( * ) Notice: Subject to any disclaimer, the term of this patent is extended or adjusted under 35 U.S.C. 154(b) by 1108 days.

(21) Appl. No.: 13/201,420

(22) PCT Filed: Feb. 12, 2010

(86) PCT No.: PCT/EP2010/051761

§ 371 (c)(1), (2), (4) Date: Nov. 23, 2011

(87) PCT Pub. No.: WO2010/092139

PCT Pub. Date: Aug. 19, 2010

(65) Prior Publication Data

US 2012/0062718 A1 Mar. 15, 2012

(30) Foreign Application Priority Data

Feb. 13, 2009 (FR) ..... 09 50916
Feb. 13, 2009 (FR) ..... 09 50919

(51) Int. Cl.
*G10H 1/18* (2006.01)
*G10H 1/40* (2006.01)

(52) U.S. Cl.
CPC . *G10H 1/18* (2013.01); *G10H 1/40* (2013.01); *G10H 2210/076* (2013.01); *G10H 2210/385* (2013.01); *G10H 2220/135* (2013.01); *G10H 2220/201* (2013.01); *G10H 2220/206* (2013.01); *G10H 2220/395* (2013.01)

(58) Field of Classification Search
USPC ..... 84/615, 653
IPC ..... G10H 1/18,2220/201, 2220/206
See application file for complete search history.

(56) References Cited

U.S. PATENT DOCUMENTS 5,166,463 A * 11/1992 Weber ..... 84/600
5,170,002 A * 12/1992 Suzuki et al. ..... 84/600

(Continued)

FOREIGN PATENT DOCUMENTS

EP 0 747 851 A 12/1996
EP 1 837 858 A 9/2007
EP 1 850 318 A 10/2007

OTHER PUBLICATIONS

Business Wire: "Movea unveils the latest in motion-sensing Technology for consumer products", Jan. 8, 2009.

(Continued)

*Primary Examiner* — David Warren
(74) *Attorney, Agent, or Firm* — Stroock & Stroock & Lavan LLP

(57) ABSTRACT

Musical rendition is provided through the use of microsensors, in particular of accelerometers and magnetometers or rate gyros, and through an appropriate processing of the signals from the microsensors. In particular, the processing uses a merging of the data output from the microsensors to eliminate false alarms in the form of movements of the user unrelated to the music. The velocity of the musical strikes is also measured. Embodiments make it possible to control the running of mp3 or wav type music files to be played back.

22 Claims, 9 Drawing Sheets

(56) References Cited

U.S. PATENT DOCUMENTS

| | | | | | |
|---|---|---|---|---|---|
| 5,648,627 | A * | 7/1997 | Usa | | 84/600 |
| 5,663,514 | A | 9/1997 | Usa | | |
| 5,684,259 | A * | 11/1997 | Horii | | 84/600 |
| 5,746,640 | A * | 5/1998 | Meadows | | 446/213 |
| 5,808,219 | A * | 9/1998 | Usa | | 84/600 |
| 5,819,206 | A | 10/1998 | Horton et al. | | |
| 6,005,181 | A * | 12/1999 | Adams et al. | | 84/734 |
| 6,011,212 | A * | 1/2000 | Rigopulos et al. | | 84/667 |
| 6,066,794 | A * | 5/2000 | Longo | | 84/626 |
| 6,088,017 | A * | 7/2000 | Tremblay et al. | | 345/156 |
| 6,150,947 | A * | 11/2000 | Shima | | 340/692 |
| RE37,654 | E * | 4/2002 | Longo | | 84/626 |
| 6,388,183 | B1 * | 5/2002 | Leh | | 84/645 |
| 7,474,197 | B2 * | 1/2009 | Choi et al. | | 340/384.7 |
| 7,489,979 | B2 * | 2/2009 | Rosenberg | | 700/94 |
| 8,222,507 | B1 * | 7/2012 | Salazar et al. | | 84/602 |
| 2001/0015123 | A1 * | 8/2001 | Nishitani et al. | | 84/615 |
| 2002/0026866 | A1 * | 3/2002 | Nishitani et al. | | 84/600 |
| 2002/0088335 | A1 * | 7/2002 | Nishitani et al. | | 84/600 |
| 2002/0166439 | A1 * | 11/2002 | Nishitani et al. | | 84/600 |
| 2003/0188627 | A1 * | 10/2003 | Longo | | 84/627 |
| 2003/0196542 | A1 * | 10/2003 | Harrison, Jr. | | 84/737 |
| 2004/0000225 | A1 * | 1/2004 | Nishitani et al. | | 84/610 |
| 2004/0046736 | A1 * | 3/2004 | Pryor et al. | | 345/156 |
| 2006/0028446 | A1 | 2/2006 | Liberty et al. | | |
| 2006/0142082 | A1 * | 6/2006 | Chiang et al. | | 463/36 |
| 2007/0021208 | A1 * | 1/2007 | Mao et al. | | 463/36 |
| 2007/0039450 | A1 * | 2/2007 | Ohshima et al. | | 84/616 |
| 2007/0113726 | A1 | 5/2007 | Oliver et al. | | |
| 2007/0118241 | A1 | 5/2007 | Rosenberg | | |
| 2007/0175321 | A1 * | 8/2007 | Baum et al. | | 84/737 |
| 2009/0211432 | A1 * | 8/2009 | Casillas et al. | | 84/465 |
| 2012/0059494 | A1 * | 3/2012 | David | | 700/94 |
| 2012/0062718 | A1 * | 3/2012 | David | | 348/77 |
| 2012/0103168 | A1 * | 5/2012 | Yamanouchi | | 84/723 |
| 2012/0174736 | A1 * | 7/2012 | Wang et al. | | 84/622 |
| 2012/0260789 | A1 * | 10/2012 | Ur et al. | | 84/470 R |
| 2013/0032023 | A1 * | 2/2013 | Pulley et al. | | 84/645 |
| 2013/0118339 | A1 * | 5/2013 | Lee et al. | | 84/725 |

OTHER PUBLICATIONS

Stephen Totilo: "One on one with Shigeru Miyamoto: from WII Music to Bowser to . . . Motion Plus?", Oct. 27, 2008.

International Search Report and Written Opinion issued in International Application No. PCT/EP2010/051761, dated Nov. 19, 2010.

* cited by examiner

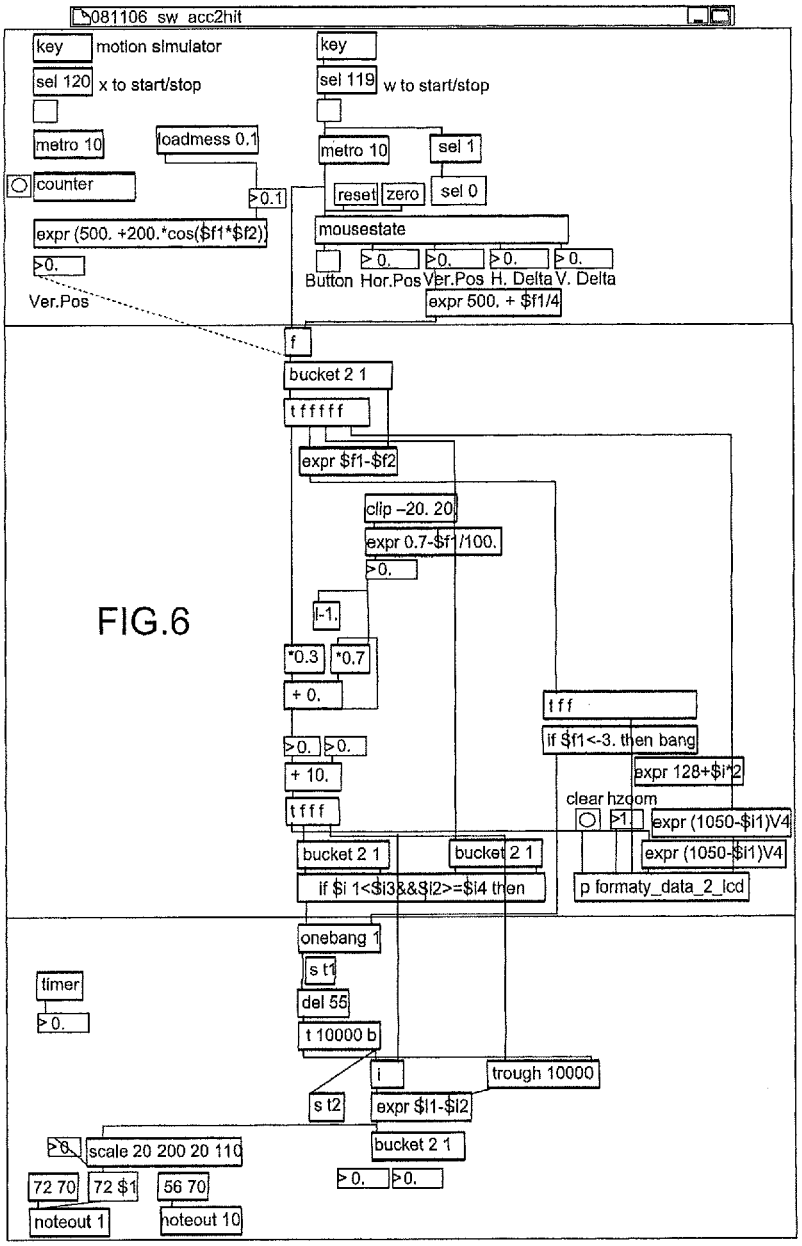
081106_sw_acc2hit
key
motion simulator
sel 120
x to start/stop
metro 10
loadmess 0.1
counter
>0.1
expr (500. +200.*cos($f1*$f2))
>0.
Ver.Pos
key
sel 119
w to start/stop
metro 10
sel 1
reset
zero
sel 0
mousestate
>0.
>0.
>0.
>0.
Button
Hor.Pos
Ver.Pos
H. Delta
V. Delta
expr 500. + $f1/4
f
bucket 2 1
t f f f f f
expr $f1-$f2
clip -20. 20
expr 0.7-$f1/100.
>0.
FIG.6
!-1.
*0.3
*0.7
+ 0.
>0.
>0.
+ 10.
t f f f
bucket 2 1
if $i 1<$i3&&$i2>=$i4 then
bucket 2 1
t f f
if $f1<-3. then bang
expr 128+$i*2
clear hzoom
>1.
expr (1050-$i1)V4
expr (1050-$i1)V4
p formaty_data_2_lcd
onebang 1
s t1
timer
>0.
del 55
t 10000 b
i
trough 10000
s t2
expr $i1-$i2
>0.
scale 20 200 20 110
bucket 2 1
>0.
>0.
72 70
72 $1
56 70
noteout 1
noteout 10

The strike speed is greater than that of the audio file: SF = 4/3

The strike speed is less than that of the audio file: SF = 4/5

DEVICE AND METHOD FOR INTERPRETING MUSICAL GESTURES

CROSS-REFERENCE TO RELATED APPLICATIONS

This application is the National Stage under 35 U.S.C. 371 of International Application No. PCT/EP2010/051761, filed Feb. 12, 2010, which claims priority to French Patent Application No. 0950916, filed Feb. 13, 2009 and French Patent Application No. 0950919, filed Feb. 13, 2009 the contents of which are incorporated herein by reference.

BACKGROUND

1. Field of the Invention

Various embodiments of the invention relate to the field of the interpretation of musical gestures or gestures acting on or as musical instruments. In particular, preferred embodiments relate to a device and a method for processing signals representative of the movements of a music player using an instrument or beating an accompanying rhythm.

2. Description of the Prior Art

Gaming or learning devices and methods have been developed to enable a musical instrument player using an object which simulates said instrument to play a score thereon, where appropriate coupled with the scores of other instruments. The instruments whose interpretation is simulated may be a guitar, a piano, a saxophone, a drum, etc. In such devices, the notes of the score are generated from the actions of the player. Such devices and methods may use buttons which make it possible to trigger the notes, where appropriate by combining said buttons. Certain devices such as the WII™ Music also use a recognition of certain gestures on the part of the musician with the pressures on the buttons to play the score. Since the WII™ Music motion sensor is an optical sensor which requires a fixed reference, its measurements are both conditioned by the position of the player relative to the reference and rudimentary, which considerably limits the interpretation possibilities. A satisfactory musical rendition in fact requires a high degree of accuracy in capturing the movements of the player which are genuinely intended to actuate the instrument.

Such a rendition is not within the scope of the prior art devices, such as U.S. Pat. No. 5,663,514.

BRIEF SUMMARY

Embodiments of the present invention provide a response to these limitations of the prior art by using the measurements of motion sensors on at least two axes and a processing of their measurements which allow for this accuracy and thus allow for a satisfactory musical rendition.

To this end, the various embodiments of the present invention disclose a device for interpreting gestures of a user comprising at least one input module for measurements comprising at least one motion capture assembly on at least a first and a second axis, a module for processing signals sampled at the output of the input module and an output module capable of playing back the musical meaning of said gestures, the signal processing module comprising a submodule for analyzing and interpreting gestures comprising a filtering function, a function for detecting meaningful gestures by comparison of the variation between two successive values in the sample of at least one of the signals originating from at least the first axis of the set of sensors with at least a first selected threshold value and a function for confirming the detection of a meaningful gesture, wherein said function for confirming the detection of a meaningful gesture is capable of comparing at least one of the signals originating from at least the second axis of the set of sensors with at least a second selected threshold value.

Advantageously, the filtering function can be executed by at least one pair of two successive low-pass recursive filters capable of receiving as input at least one of the signals output from the module.

Advantageously, the function for detecting meaningful gestures can be capable of identifying changes of sign between two successive values in the sample of the difference between at least one output from the first filter of at least one of the pairs of filters at the current value and at least one output from the second filter of the same pair of filters for the same signal at the preceding value.

Advantageously, the submodule for analyzing and interpreting gestures can also comprise a function for measuring the velocity of the gesture detected at the output of the detection confirmation function.

Advantageously, the function for measuring velocity can be capable of computing the travel (Max-Min) between two detected meaningful gestures.

Advantageously, the second filter can be capable of operating at a cut-off frequency less than that of the first filter.

Advantageously, the input module can comprise at least a first sensor of accelerometer type and a second sensor chosen from the group of sensors of magnetometer and rate gyro types.

Advantageously, the function for detecting meaningful gestures can be capable of receiving as input at least one output from the second recursive filter of one of the pairs of filters applied to at least one of the signals from the first sensor.

Advantageously, the function for confirming the detection of a meaningful gesture can be capable of receiving as input at least one output from the second recursive filter of one of the pairs of filters applied to at least one of the signals from the second sensor.

Advantageously, the threshold selected for the function for confirming the detection of a meaningful gesture can be of the order of 5/1000 as a relative value of the filtered signal.

Advantageously, the input module can receive the signals from at least two sensors positioned on two independent parts of the body of the user, a first sensor supplying, via one of the pairs of recursive filters, a signal as input for the function for detecting meaningful gestures and a second sensor supplying, via one of the pairs of recursive filters, a signal as input for the function for measuring the velocity of the gesture detected at the output of the function for confirming the detection of a meaningful gesture.

Advantageously, the signal processing module can comprise an input submodule for prerecorded multimedia contents.

Advantageously, the input submodule for multimedia contents can comprise a function for partitioning said multimedia contents into time windows that can be used to perform a second confirmation of detection of the detected meaningful gestures.

Advantageously, the input module can be capable of transmitting to the processing module a signal representative of the position of the user in a plane substantially orthogonal to the direction of the detected meaningful gesture to perform a second confirmation thereof.

Advantageously, the output module can comprise a submodule for playing back a prerecorded file of signals to be played back and in that the processing module comprises a submodule for controlling the timing of said prerecorded signals, said playback submodule being able to be programmed to determine the times at which strikes controlling the runrate of the file are expected, and in that said timing control submodule is capable of computing, for a certain number of control strikes, a relative corrected speed factor of preprogrammed strikes in the playback submodule and strikes actually entered in the timing control submodule and a relative intensity factor of the velocities of said strikes actually entered and expected then of adjusting the runrate of said timing control submodule to adjust said corrected speed factor on the subsequent strikes to a selected value and the intensity of the signals output from said playback submodule according to said relative intensity factor of the velocities.

Advantageously, the velocity of the entered strike can be computed on the basis of the deviation of the signal output from the second sensor.

Advantageously, the input module can also comprise a submodule capable of interpreting gestures of the user whose output is used by the timing control submodule to control a characteristic of the audio output selected from the group consisting of vibrato and tremolo.

Advantageously, the playback submodule can comprise a function for placing tags in the file of prerecorded signals to be played back at times at which strikes controlling the runrate of the file are expected, said tags being generated automatically according to the rate of the prerecorded signals and being able to be shifted by a MIDI interface.

Advantageously, the value selected in the timing control submodule to adjust the running speed of the playback submodule can be equal to a value selected from a set of computed values of which one of the limits is computed by application of a corrected speed factor CSF equal to the ratio of the time interval between the next tag and the preceding tag minus the time interval between the current strike and the preceding strike to the time interval between the current strike and the preceding strike and whose other values are computed by linear interpolation between the current value and the value corresponding to that of the limit used for the application of the speed factor CSF.

Advantageously, the value selected in the timing control submodule to adjust the running speed of the playback submodule can be equal to the value corresponding to that of the limit used for the application of the corrected speed factor.

Various embodiments also disclose a method for interpreting meaningful gestures of a user comprising at least one step for inputting measurements originating from at least one motion capture assembly along at least a first and a second axis, a step for processing signals sampled at the output of the input step and an output step capable of playing back the musical meaning of said gestures, the signal processing step comprising a substep for analyzing and interpreting gestures comprising at least one filtering step, a function for detecting meaningful gestures by comparison of the variation between two successive values in the sample of at least one of the signals originating from at least the first axis of the set of sensors with at least a first selected threshold value and a function for confirming the detection of a meaningful gesture, wherein said function for confirming the detection of a meaningful gesture is capable of comparing at least one of the signals originating from at least the second axis of the set of sensors with at least a second selected threshold value.

Advantageously, the output step can comprise a substep for playing back a prerecorded file of signals to be played back and in that the processing step comprises a substep for controlling the timing of said prerecorded signals, said playback substep being capable of determining the times at which strikes controlling the runrate of the file are expected, and said timing control substep being capable of computing, for a certain number of control strikes, a relative corrected speed factor of preprogrammed strikes in the playback substep and of strikes actually entered during the timing control substep and a relative intensity factor of the velocities of said strikes actually entered and expected then of adjusting the runrate of said prerecorded file to adjust said corrected speed factor on the subsequent strikes to a selected value and the intensity of the signals output from the playback step according to said relative intensity factor of the velocities.

Another advantage of certain embodiments of the invention is that they use inexpensive microsensors (accelerometers and magnetometers or rate gyros). They can be used to play with the hands and/or beat time with the feet. They do not require a lengthy learning phase and can be used by a number of players. They can be used with a large number of movements and instruments. They can also be used without an object simulating any instrument.

Furthermore, embodiment devices and methods of the invention can be used to control the runrate and the playback volume of an mp3 or way audio file while ensuring a satisfactory musical rendition. Furthermore, certain embodiments make it possible to control the running of the prerecorded audio files intuitively. New algorithms for controlling the running can also be incorporated easily in embodiment devices.

BRIEF DESCRIPTION OF THE DRAWINGS

FIG. 6 represents a general flow diagram of the processing operations in one embodiment of the invention using only a rate gyro.

DETAILED DESCRIPTION

Figure 1:
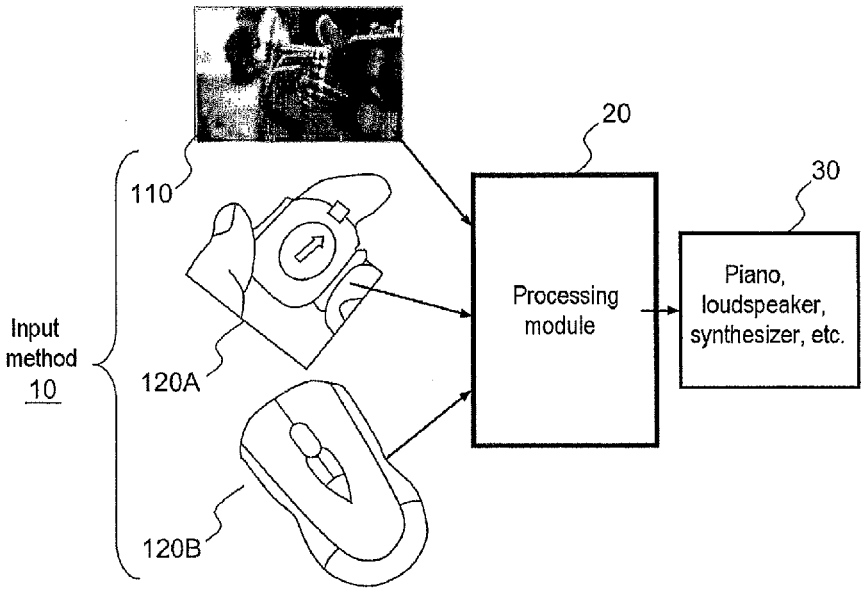
FIG. 1 represents differing contexts of use of the invention according to a number of embodiments.

FIG. 1 represents three embodiment methods 110, 120A and 120B for entering 10 musical gestures in a processing module 20 for playback by a musical synthesis module 30.

The left-hand side of FIG. 1 shows, from top to bottom, the three musical gesture input methods 10:

- a musician 110 plays a guitar on which have been fixed one or more motion sensors like the MotionPod™ from Movea™ it is then the movements of the guitar which are measured by the motion sensors and supplied to the processing unit 20;
- a musician 120A directly wears motion sensors of the same type on a part of the body (hand, forearm, arm, foot, leg, thigh, etc.); he can play the score of an instrument or simply beat a rhythm;
- a musician 120B may also actuate a GyroMouse™ or even an AirMouse™ from Movea which is a three-dimensional remote control comprising a triaxial rate gyro that makes it possible to monitor a point moving over a plane that is used, offering the possibility of using either the movements of the point or the measurements of one or more rate gyro axes.

A MotionPod includes a triaxial accelerometer, a triaxial magnetometer, a preprocessing capability making it possible to preform signals from the sensors, a radiofrequency transmission module for transmitting said signals to the processing module itself and a battery. This motion sensor is called "3A3M" (three accelerometer axes and three magnetometer axes). The accelerometers and magnetometers are market-standard microsensors with a small footprint, low consumption and low cost, for example a three-channel accelerometer from the company Kionix™ (KXPA4 3628) and HoneyWell™ magnetometers of HMC1041Z type (1 vertical channel) and HMC1042L type for the 2 horizontal channels. There are other suppliers: Memsic™ or Asahi Kasei™ for the magnetometers and STM™, Freescale™, Analog Device™ for the accelerometers, to cite only a few. In the MotionPod, for the 6 signal channels, there is only an analog filtering and then, after analog-digital conversion (12-bit), the raw signals are transmitted by a radiofrequency protocol in the Bluetooth™ band (2.4 GHz) optimized for consumption in this type of application. The data therefore arrive raw at a controller which can receive the data from a set of sensors. The data are read by the controller and made available to the software. The rate of sampling can be adjusted. By default, it is set to 200 Hz. Higher values (up to 3000 Hz, or higher) can nevertheless be considered, allowing for a greater accuracy in the detection of impacts for example. The radiofrequency protocol of the MotionPod makes it possible to ensure that the data is made available to the controller with a controlled delay, which in this case must not exceed 10 ms (at 200 Hz), which is important for music.

An accelerometer of the above type makes it possible to measure the longitudinal displacements on its three axes and, by transformation, angular displacements (except around the direction of the Earth's gravitational field) and orientations according to a three-dimensional Cartesian reference frame. A set of magnetometers of the above type makes it possible to measure the orientation of the sensor to which it is fixed relative to the Earth's magnetic field, and therefore relative to the three axes of the reference frame (except around the direction of the Earth's magnetic field). The 3A3M combination supplies complementary and smooth movement information.

In fact, in an embodiment of the invention, only the information relating to one of the axes, the vertical Z axis, or one of the other two axes, is used. It is therefore possible in principle to use only a monoaxial sensor of each of the types, when two types of sensors (accelerometer and magnetometer or accelerometer and rate gyro) are used. In practice, given the inexpensive availability of 3A3M sensor modules incorporating transmission and processing functions for the six channels, it is this approach which is preferred.

Other motion sensors can be used, for example a combination of accelerometer and of rate gyro (so-called "3A3G" sensors) or even just one triaxial rate gyro, as explained below in the description as a commentary to other figures.

When a number of sets of motion sensors are used, the remote controller of the MotionPod (at the input of the processing module 20, 210) synthesizes the signals from the sets of sensors. A trade-off has to be found between the number of sensors, the sampling frequency of the sensors and the autonomy in terms of energy consumption of the sets of sensors. Hereinafter in the description, output signal from the accelerometer or from the magnetometer in the singular will be used without differentiation to designate the outputs of the controller depending on whether the input data originate from a single 3A3M sensor module or from a set of 3A3M modules synthesized in the controller.

The AirMouse comprises two sensors of rate gyro type, each with one rotation axis. The rate gyros used are Epson brand, reference XV3500. Their axes are orthogonal and deliver pitch angles (yaw or rotation about the axis parallel to the horizontal axis of a plane situated facing the user of the AirMouse) and of yaw (pitch or rotation about an axis parallel to the vertical axis of a plane situated facing the user of the AirMouse). The instantaneous pitch and yaw speeds measured by the two rate gyro axes are transmitted by radiofrequency protocol to a controller of the input module (10) and converted by said controller into movement of a cursor in a screen situated facing the user. In an embodiment application, it is possible to use either one of the signals controlling the cursor (in Z or in Y), even both, or a direct measurement signal output from one of the rate gyro axes.

The functionalities and the architecture of the processing module 20 will be described in conjunction with FIG. 2.

An output module 30 plays back the sounds produced by the combination of prerecorded contents and the capture of the musical gestures produced by the player via the input module 10. It may be a simple loudspeaker or a synthesizer.

Figure 2:
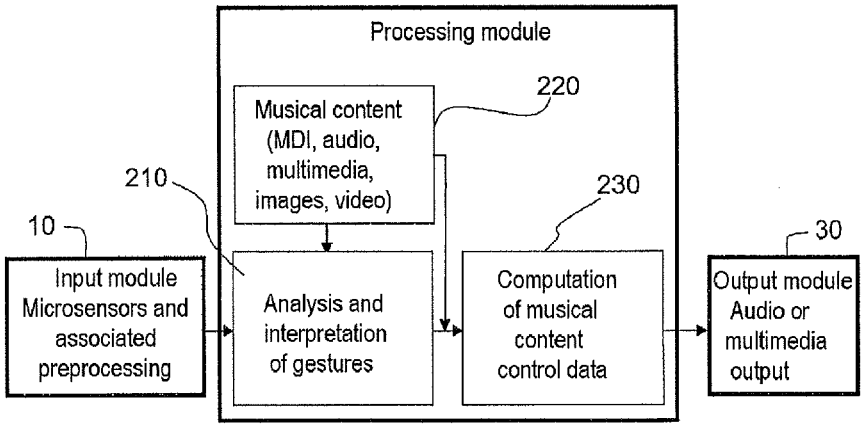
FIG. 2 is a simplified representation of a functional architecture of a device for interpreting musical gestures according to one embodiment of the invention.

The functional architecture of an embodiment device is described in FIG. 2. The modules 10 and 30 will not be described further.

The module 20 processes the signals received from the input module 10 in a module for analyzing and interpreting gestures 210 whose outputs are supplied to a module for computing control data for the musical content 230. A prerecorded multimedia content is also supplied by a module 220 to the module 230.

To correctly specify the algorithm for analyzing and interpreting the musical body language implanted in the module 210, it is desirable to take into account the specifics of said body language. In particular, playing a 5-minute piece of music for example by beating a medium-fast tempo at 120 bpm (beats per minute) translates into 600 beats performed by the user. Now, in a musical context, a single error is reflected in a sensory break or a loss of interest in the device. In a false alarm situation, the system detects nonexistent beats, and in a nondetection situation, the playing of the piece is interrupted. Now, in a situation of musical interpretation by beating time, the user adopts a body language on the one hand which is specific to him, and on the other hand which allows for a certain variability within his specific body language. Furthermore, physiological motor phenomena specific to human beings, which are themselves dependent on the beating speed, are superimposed on this variability (there is a quasi-sinusoidal mode at high speed, but with strong bounces at slow speed).

These observations can lead to a number of consequences:

- it is preferable to use algorithms that achieve an accuracy of the order of 1 in 1000, a very high value in a little known variability context (human expressive movement);
- accelerometers on their own do not as yet achieve such performance, for at least two reasons (bounce in the case of medium or slow speed, difficulty in anticipating and therefore in producing correct movement power information), hence the choice made to use bimodal sensors;
- the processing algorithms are preferably very adaptable.

Furthermore, the behavior of the user can depend directly on his interaction with the content that he is interpreting. It is therefore desirable to provide an in-situ method, that is to say, placing the human system in an action/perception loop including all the aspects involved (content, brain and cognitive processes, body language, actuators, sensors, etc.).

To meet these specifications, the general processing principle implemented in the module 210 can have the following two characteristics:

- an adaptive processing to eliminate the components of the signals exhibiting slow variations (of the order of a second);
- the use of the outputs of a sensor (a magnetometer or a rate gyro) to detect a strike;
- the use of the outputs of the other sensor (the accelerometer or one of the measurements from the rate gyro if this sensor is used on its own), to measure the intensity of the strike.

The module 220 is used to insert prerecorded contents of MIDI (Musical Instrument Digital Interface) type coming from an electronic musical instrument, audio coming from a drive (MP3—MPEG (Moving Picture Expert Group) 1/2 Layer 3, WAV—WAVeform audio format, WMA—Windows Media Audio, etc. . . . ), multimedia, images, video, etc., via an appropriate interface. The outputs from the module 220 are supplied concurrently to the module 210 (to enable the reactions of the music player to be taken into account) and to the module 230 to be then played back as output from the processing device.

The module 230 makes it possible to synthesize the musical gestures interpreted by the module 210 and the prerecorded contents output from the module 220. The simplest mode is to play a fragment, for example MP3-coded or of a midi file (even of a video file) each time a strike is detected by the module 210, which will then search sequentially for the fragments in the module 220. This mode allows for numerous interesting applications. It is much more flexible and powerful when 220 incorporates a method such as the one we have disclosed in application No. FR07/55244 entitled "Computer-assisted music interpretation system" and whose holder is the inventor of the present application. The embodiment device disclosed in this invention comprises two memories, one of which contains musical data defining all the musical events forming the piece of music to be interpreted and the other containing the sequence of actions used to play back the stored musical events and means for establishing said musical information by comparing the data stored in the first memory containing the musical data and the memory containing the sequence of actions. In this case, the user will have complete control over what he wants to play and when, and over what is left to the initiative of the machine (for example, an accompaniment).

FIG. 3 (subdivided into 3*a* and 3*b* for legibility reasons) represents a general flow diagram of the processing operations in an embodiment of the invention that uses an accelerometer and a magnetometer or a rate gyro. Hereinafter in the description concerning this figure, whenever the word magnetometer is used, it will designate a magnetometer or a rate gyro without differentiation. All the processing operations are performed by software in the module 210.

Figure 4:
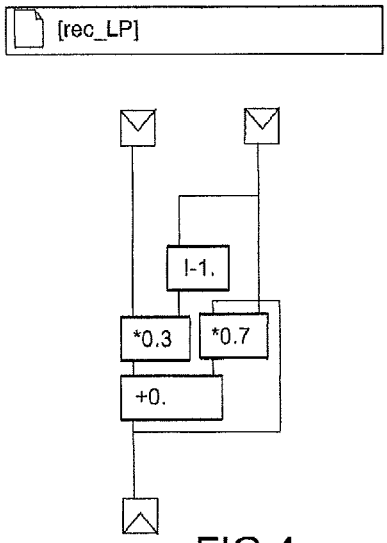
FIG. 4 represents a flow diagram of the filtering of the signals from the motion sensors in one embodiment of the invention.

The processing operations comprise, first of all, a low-pass filtering of the outputs of the sensors of the two modalities (accelerometer and magnetometer) whose detailed operation is explained by FIG. 4. This filtering of the signals at the output of the controller of the motion sensors uses a 1st order recursive approach. The gain of the filter may, for example, wice be set to 0.3. In this case, the equation of the filter is given by the following formula:

$$\text{Output}(z(n))=0.3*\text{Input}(z(n-1))+0.7*\text{Output}(z(n-1))$$

In which, for each of the modalities:

z is the reading of the modality on the axis used;

n is the reading of the current sample;

n−1 is the reading of the preceding sample.

The processing then includes a low-pass filtering of the two modalities with a cut-off frequency less than that of the first filter. This lower cut-off frequency is the result of a choice of a coefficient of the second filter which is less than the gain of the first filter. In the case chosen in the above example in which the coefficient of the first filter is 0.3, the coefficient of the second filter may be set to 0.1. The equation of the second filter is then (with the same notations as above):

$$\text{Output}(z(n))=0.1*\text{Input}(z(n-1))+0.9*\text{Output}(z(n-1))$$

Then, the processing includes a detection of a zero in the drift of the signal output from the accelerometer with the measurement of the signal output from the magnetometer.

The following notations are used:

- A(n) the signal output from the accelerometer in the sample n;
- AF1(*n*) the signal from the accelerometer at the output of the first recursive filter in the sample n;
- AF2(*n*) the signal AF1 filtered again by the second recursive filter in the sample n;
- B(n) the signal from the magnetometer in the sample n;
- BF1(*n*) the signal from the magnetometer at the output of the first recursive filter in the sample n;
- BF2(*n*) the signal BF1 filtered again by the second recursive filter in the sample n.

Then, the following equation can be used to compute a filtered drift of the signal from the accelerometer in the sample n:

$$FDA(n)=AF1(n)-AF2(n-1)$$

A negative sign for the product FDA(n)*FDA(n−1) indicates a zero in the drift of the filtered signal from the accelerometer and therefore detects a strike.

For each of these zeros of the filtered signal from the accelerometer, the processing module checks the intensity of the deviation of the other modality at the filtered output of the magnetometer. If this value is too low, the strike is considered not to be a primary strike but to be a secondary or tertiary strike and is discarded. The threshold making it possible to discard the non-primary strikes depends on the expected amplitude of the deviation of the magnetometer. Typically, this value will be of the order of 5/1000 in the applications envisaged. This part of the processing therefore makes it possible to eliminate the meaningless strikes.

Finally, for all the primary strikes detected, the processing module computes a strike velocity (or volume) signal by using the deviation of the signal filtered at the output of the magnetometer.

The value DELTAB(n) is introduced into the sample n which can be considered to be the pre-filtered signal of the centered magnetometer and which is computed as follows:

$$\text{DELTA}B(n)=BF1(n)-BF2(n)$$

The minimum and maximum values of DELTAB(n) are stored between two detected primary strikes. An acceptable value VEL(n) of the velocity of a primary strike detected in a sample n is then given by the following equation:

$$\text{VEL}(n)=\text{Max}\{\text{DELTA}B(n),\text{DELTA}B(p)\}-\text{Min}\{\text{DELTA}B(n),\text{DELTA}(p)\}$$

In which p is the index of the sample in which the preceding primary strike was detected. The velocity is therefore the travel (Max-Min difference) of the drift of the signal between two detected primary strikes, characteristic of musically meaningful gestures.

Figure 5:
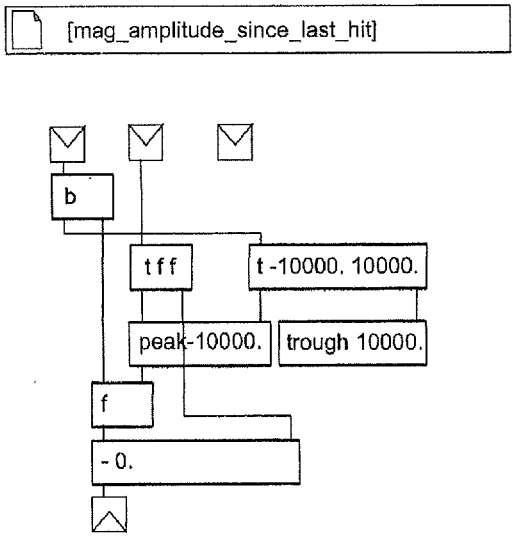
FIG. 5 represents a flow diagram of the detection of the power of the signals from the motion sensors in one embodiment of the invention.

This part of the processing is illustrated by FIG. 5.

An adaptive processing is thus performed, because the processing of the magnetic modality includes a centering of the signal. From the signal itself are subtracted its own slow variations (see formula above). Thus, for example if the user turns by 60° to his right, the magnetic signals received will be shifted, but the corresponding offset will be removed by the subtraction concerned, retaining only the rapid variations due to the musical rhythm.

This processing according to embodiments of the invention makes it possible to interpret, without a single error, pieces lasting a few minutes, with a fine control of both playing speed and volume, both when the sensors are placed on the hand of the player or when they are situated on the foot of a player who beats time with his foot. The embodiment devices can be used as such, that is to say without any calibration, even of the magnetometers (the device in fact can work only on signals stripped of continuous components). It may, however, be advantageous to perform a calibration at the start of play, a calibration which may also be renewed on each strike. It is then desirable to have the filtering designed to dispense with the slow variations and this calibration on each strike done in parallel. In this case, it is no longer necessary to filter using the second filter. On the contrary, the calibration will ensure that, in an "approximate" position known to the user (at the moment of the strike), the magnetometer supplies a reference datum by virtue of the calibration. In a way, the data are realigned by these calibrations, whereas they were previously realigned by the second filtering. It is also possible to imagine combining the second filtering and the calibration.

Moreover, these processing operations as a whole can provide:

- a trigger signal that can be used to synchronize the playing of a MIDI file, or to synchronize the running of an MP3, WAV or WMA type audio file, which is described later;
- an amplitude signal, which can be used to control the volume of a MIDI drive (or rather, in general, the velocity of the notes played) or the playback volume of an audio file.

FIG. 6 is a general flow diagram of the processing operations in an embodiment of the invention that uses only a rate gyro.

The AirMouse or the GyroMouse from Movea (player 120*b* of FIG. 1) is used, for example, as input device.

The processing performed in the module 210 is comparable to the processing described above, except that we do not use more than a single sensor datum which can in effect be considered, as a first approximation, to be physically midway between the accelerometer datum and the magnetometer datum which supplies absolute angles. The rate gyro is in this case used in both detections: that of the primary strike, with a processing comparable to that of the accelerometer above, except that the second filtering is not necessary, because a first filtering is already performed in the AirMouse or the GyroMouse. The two filterings may, however, be added together.

In this case, crossings between the drift of the signal obtained from the AirMouse are detected, and this same signal low-pass filtered recursively.

The detection of the power of the gesture is also based on a measurement of the travel between two successive detected primary strikes.

This velocity computation gives usable results, but is less effective than the approach with two modalities. Because of the intermediate nature—between measurements from an accelerometer and measurements from a magnetometer—of the measurements from the rate gyro, said rate gyro is sufficient for both detections, but is it is also less effective than the dedicated modalities. This solution provides a trade-off which is not optimal but which may provide other opportunities. On the one hand, the AirMouse is more accessible, at least for the time being, to the general public and therefore is of interest from this point of view even if it does not offer the fine level of control of the bimodality solution. In a way, the Airmouse lies between the Wii Music and a sensor providing two motion capture modes. Moreover, the mouse buttons provide additional controls in order, for example, to change a sound, or to switch to the next piece, or to operate the pedal of a sampled piano for example.

The various embodiments of the invention can be enhanced by the variants explained below.

One variant embodiment uses two sensor modules in each of the player's hands, one of the modules being dedicated to detecting primary strikes and the other to measuring the velocity.

It is also possible to exploit the other axes of the sensors to determine a heading information which makes it possible to introduce a pan control and thus improve the centering to make the detections completely independent of the positioning of the player.

Another variant embodiment that makes it possible to improve the robustness involves exploiting the knowledge of the current musical content. Time windows are then introduced, which are deduced from the current content, in which a strike detected as primary is not taken into account because it is inconsistent with said current content. In fact, this consistency can exploit a measurement of the current playing speed of the person (the time between the last two strikes) and compare it to the time elapsing between the two fragments contained in the module 220. If these two measurements differ excessively (for example by more than 25%) an acceleration (or a deceleration) is registered which seems excessive relative to what is being played. It is deduced therefrom that there has been a false detection. When such a false detection is identified, it in fact always corresponds to a strike devoid of musical sense, from which it is deduced that it is a spurious detection. It is therefore purely and simply disregarded (it does not trigger any multimedia fragment). Conversely, a nondetection can be overcome simply, the paced elements of the piece being played by using the last two detected strikes.

Figure 7:
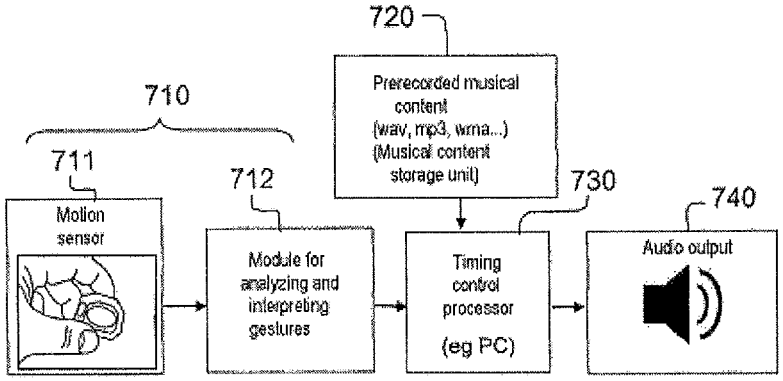
FIG. 7 is a simplified representation of a functional architecture of a device for controlling the runrate of a prerecorded audio file by using the device and the method of the invention.

FIG. 7 is a simplified representation of a functional architecture of a device for controlling the running speed of a prerecorded audio file by using an embodiment device and method.

The characteristics of the module 720, for the input of the signals to be played back, of the module 730 for controlling the timing rhythm and of the audio output module 740 are described later. The motion sensors of Motion Pod or Air Mouse type described above are, in the embodiment described here, used to control the runrate of a prerecorded audio file. The module for analyzing and interpreting gestures 712, adapted to this embodiment, supplies signals that can be directly exploited by the timing control processor 730. The signals on one axis of the accelerometer and of the magnetometer of the Motion Pod are combined according to the method described above.

The processing operations advantageously comprise, first of all, a double low-pass filtering of the outputs of the sensors of the two modalities (accelerometer and magnetometer) which has already been described above in relation to FIG. 4.

Then, the processing includes the detection of a zero in the drift of the signal output from the accelerometer with the measurement of the signal output from the magnetometer according to the modalities explained above in comments to FIGS. 3*a* and 3*b*.

The modalities enabling the embodiment device to control the running of an mp3, wav or similar type file are explained below.

A prerecorded music file 720 with one of the standard formats (MP3, WAV, WMA, etc.) is taken from a storage unit by a drive. This file has associated with it another file including time marks, or "tags", at predetermined instants; for example, the table below indicates nine tags at the instants in milliseconds which are indicated alongside the index of the tag after the comma:

| |
|---|
| 1, 0; |
| 2, 335.411194; |
| 3, 649.042419; |
| 4, 904.593811; |
| 5, 1160.145142; |
| 6, 1462.1604; |
| 7, 1740.943726; |
| 8, 2054.574951; |
| 9, 2356.59; |

The tags can advantageously be placed at the beats of the same index in the piece that is being played. There is, however, no limitation on the number of tags. There are a number of possible techniques for placing tags in a prerecorded piece of music:

- manually, by searching on the musical wave for the point corresponding to a rhythm where a tag is to be placed; this is a feasible but tedious process;
- semi-automatically, by listening to the prerecorded piece of music and by pressing a computer keyboard or MIDI keyboard key when a rhythm where a tag that is to be placed is heard;
- automatically, by using an algorithm for detecting rhythms which places the tags at the right place; at the present time, the algorithms are not sufficiently reliable for the result not to have to be finished by using one of the first two processes, but this automation can be complemented with a manual phase for finishing the created tags file.

The module 720 for the input of prerecorded signals to be played back can process different types of audio files, in the MP3, WAV, WMA formats. The file may also contain multimedia content other than a simple sound recording. This may be, for example, video content, with or without sound tracks, which can be marked with tags and whose running can be controlled by the input module 710.

The timing control processor 730 handles the synchronization between the signals received from the input module 710 and the prerecorded piece of music 720, in a manner explained in comments to FIGS. 9A and 9B.

The audio output 740 plays back the prerecorded piece of music originating from the module 720 with the rhythm variations introduced by the commands from the input module 710 interpreted by the timing control processor 730. Any sound playback device can do this, notably headphones, and loudspeakers.

Figure 8A:
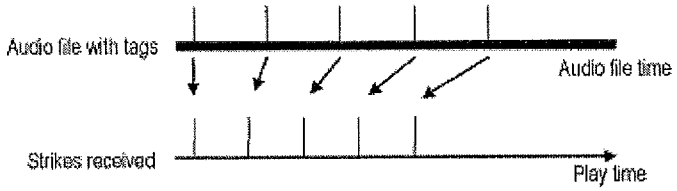
FIGS. 8*a* and 8*b* represent two cases of control of the running of an audio file in which, respectively, the strike speed is higher/lower than that at which the audio track runs.
Figure 8B:
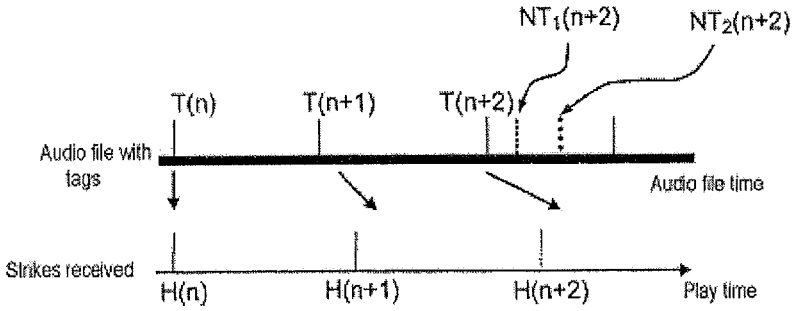

FIGS. 8A and 8B represent cases where, respectively, the strike speed is higher/lower than the running speed of the audio track.

On the first strike identified by the motion sensor 711, the audio player of the module 720 starts playing the prerecorded piece of music at a given pace. This pace may, for example, be indicated by a number of preliminary small strikes. Each time the timing control processor receives a strike signal, the current playing speed of the user is computed. This may, for example, be expressed as the speed factor SF(n) computed as the ratio of the time interval between two successive tags T, n and n+1, of the prerecorded piece to the time interval between two successive strikes H, n and n+1, of the user:

$$SF(n)=[T(n+1)-T(n)]/[H(n+1)-H(n)]$$

In the case of FIG. 8*a*, the player speeds up and takes the lead over the prerecorded piece: a new strike is received by the processor before the audio player has reached the sample of the piece of music where the tag corresponding to this strike is placed. For example, in the case of the figure, the speed factor SF is 4/3. On reading this SF value, the timing control processor skips the playing of the file 720 to the sample containing the tag with the index corresponding to the strike. A portion of the prerecorded music is therefore lost, but the quality of the musical rendition is not excessively disturbed because the attention of those listening to a piece of music is generally concentrated on the main rhythm elements and the tags will normally be placed on these main rhythm elements. Furthermore, when the player skips to the next tag, which is a main rhythm element, the listener who is waiting for this element will pay less attention to the absence of the portion of the prerecorded piece which will have been skipped, this skip thus passing almost unnoticed. The listening quality may be further enhanced by applying a smoothing of the transition. This smoothing may, for example, be applied by interpolating therein a few samples (ten or so) between before and after the tag to which the player is made to skip to catch up on the strike speed of the player. The playing of the prerecorded piece continues at the new speed resulting from this skip.

In the case of FIG. 8*b*, the player slows down and lags behind the prerecorded piece of music: the audio player reaches a point where a strike is expected before said strike is performed by the player. In a musical listening context, it is obviously not possible to stop the player to wait for the strike. Therefore, the audio playback continues at the current speed, until the expected strike is received. It is at this moment that the speed of the player is changed. A crude method consists in setting the speed of the player according to the speed factor SF computed at the moment when the strike is received. This method already gives qualitatively satisfactory results. A more sophisticated method consists in computing a corrected playback speed which makes it possible to resynchronize the playback tempo on the player's tempo.

Figure 3A:
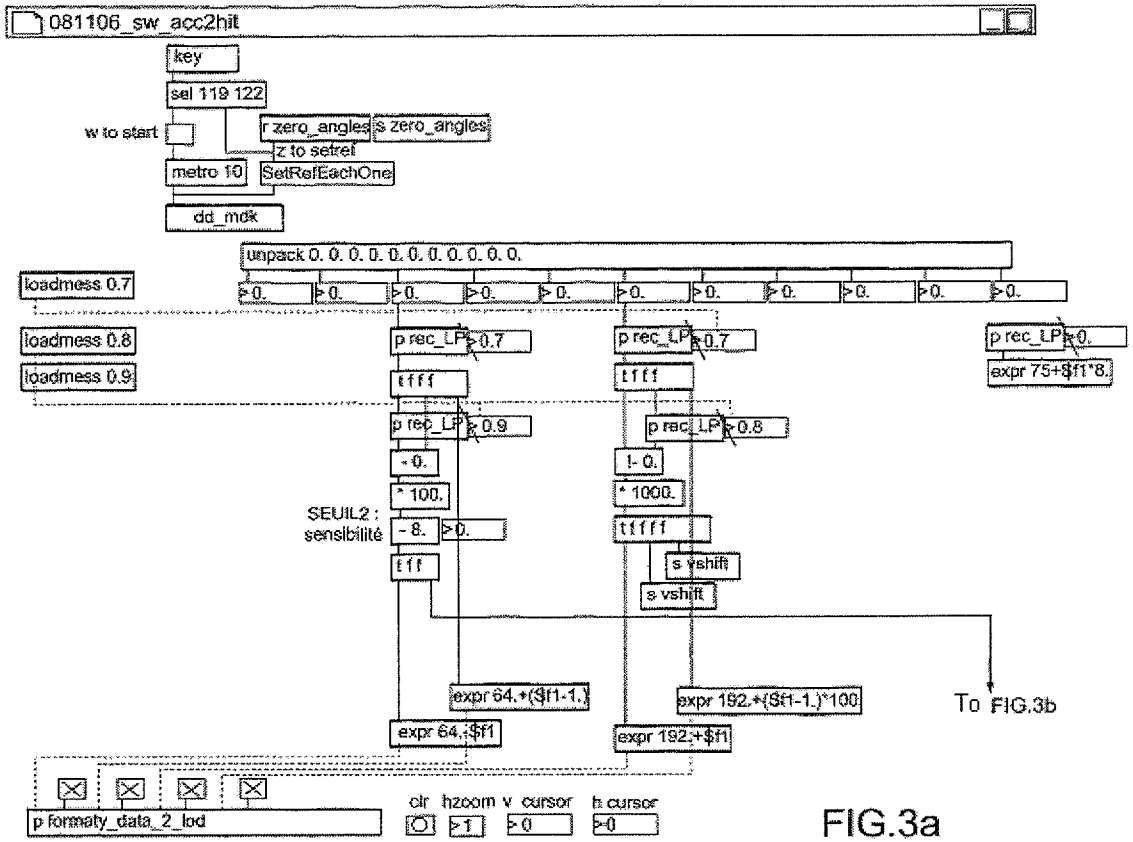
FIG. 3 (3*a*, 3*b*) represents a general flow diagram of the processing operations in one embodiment of the invention using an accelerometer and a magnetometer or a rate gyro.
Figure 3B:
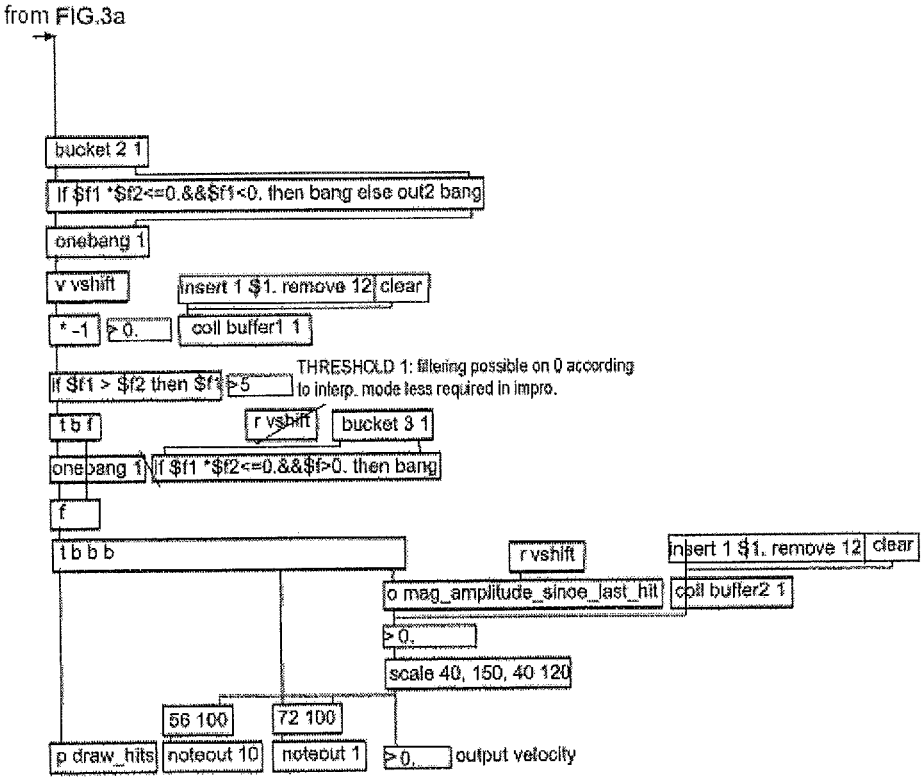

Three positions of the tags at the instant n+2 (in the timescale of the audio file) before change of player speed are indicated in FIG. 3B:

- the first starting from the left T(n+2) is the one corresponding to the running speed before the player slowed down;

the second, $NT_1(n+2)$, is the result of the computation consisting in adjusting the running speed of the playback device to the strike speed of the player by using the speed factor SF; it can be seen that, in this case, the tags remain ahead of the strikes;

the third, $NT_2(n+2)$, is the result of a computation in which a corrected speed factor CSF is used; this corrected factor is computed so that the times of the next strike and tag are identical, as can be seen in FIG. 3B.

CSF is the ratio of the time interval of the strike n+1 to the tag n+2 related to the time interval of the strike n+1 to the strike n+2. Its computation formula is as follows:

$$CSF=\{[T(n+2)-T(n)]-[H(n+1)-H(n)]\}/[H(n+1)-H(n)]$$

It is possible to enhance the musical rendition by smoothing the profile of the tempo of the player. For this, instead of adjusting the running speed of the playback device as indicated above, it is possible to compute a linear variation between the target value and the starting value over a relatively short duration, for example 50 ms, and change the running speed through these different intermediate values. The longer this adjustment time becomes, the smoother the transition will be. This allows for a better rendition, notably when many notes are played by the playback device between two strikes. However, the smoothing is obviously done to the detriment of the dynamic of the musical response.

Another enhancement, applicable to the embodiment comprising one or more motion sensors, consists in measuring the strike energy of the player or velocity to control the audio output volume. The manner in which the velocity is measured indicated above in the description.

Figure 9:
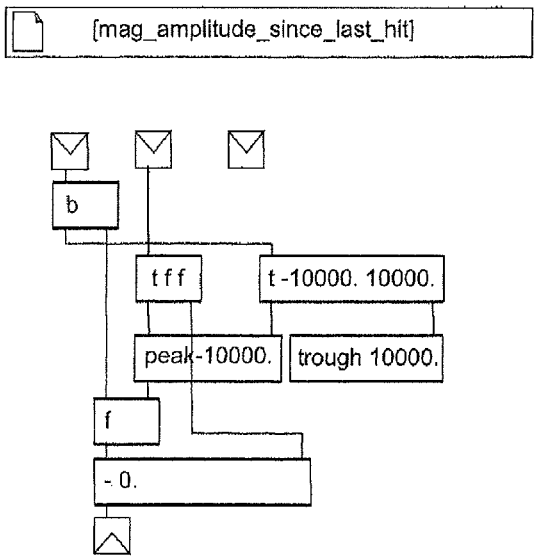
FIG. 9 represents a flow diagram of the processing operations of the function for measuring the strike velocity in a mode for controlling the running of an audio file.

This part of the processing performed by the module 712 for analyzing and interpreting gestures is represented in FIG. 9.

For all the primary strikes detected, the processing module computes a strike velocity (or volume) signal by using the deviation of the signal filtered at the output of the magnetometer.

Using the same notations as above in commentary to FIGS. 3*a* and 3*b*, the value DELTAB(n) is introduced into the sample n which can be considered to be the prefiltered signal from the centered magnetometer and which is computed as follows:

$$DELTAB(n)=BF1(n)-BF2(n)$$

The minimum and maximum values of DELTAB(n) are stored between two detected primary strikes. An acceptable value VEL(n) of the velocity of a primary strike detected in a sample n is then given by the following equation:

$$VEL(n)=Max\{DELTAB(n),DELTAB(p)\}-Min\{DELTAB(n),DELTA(p)\}$$

In which p is the index of the sample in which the preceding primary strike was detected. The velocity is therefore the travel (Max-Min difference) of the drift of the signal between two detected primary strikes, characteristic of musically meaningful gestures.

It is also possible to envisage, in this embodiment comprising a number of motion sensors, using other gestures to control other musical parameters such as the spatial origin of the sound (or panning), vibrato or tremolo. For example, a sensor in a hand will make it possible to detect the strike while another sensor held in the other hand will make it possible to detect the spatial origin of the sound or the tremolo. Rotations of the hand may also be taken into account: when the palm of the hand is horizontal, a value of the spatial origin of the sound or of the tremolo is obtained; when the palm is vertical, another value of the same parameter is obtained; in both cases, the movements of the hand in space provide the detection of the strikes.

In the case where a MIDI keyboard is used, the controllers conventionally used may also be used in this embodiment of the invention to control the spatial origin of the sounds, tremolo or vibrato.

Various embodiments of the invention may advantageously be implemented by processing the strikes through a MAX/MSP program.

Figure 10:
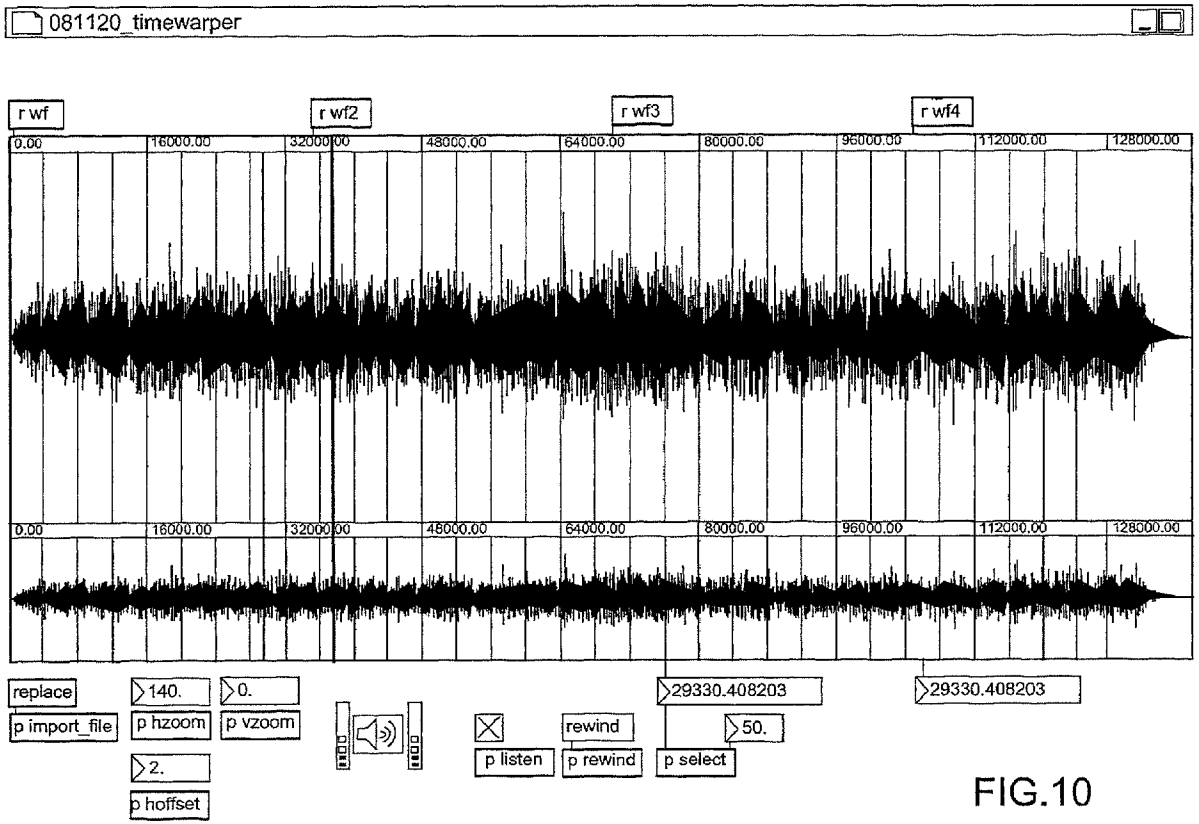
FIG. 10 represents a general flow diagram of the processing operations enabling the running of an audio file to be controlled.

FIG. 10 shows the general flow diagram of the processing operations in such a program.

The display in the figure shows the wave form associated with the audio piece loaded in the system. There is a conventional part making it possible to listen to the original piece.

Figure 11:
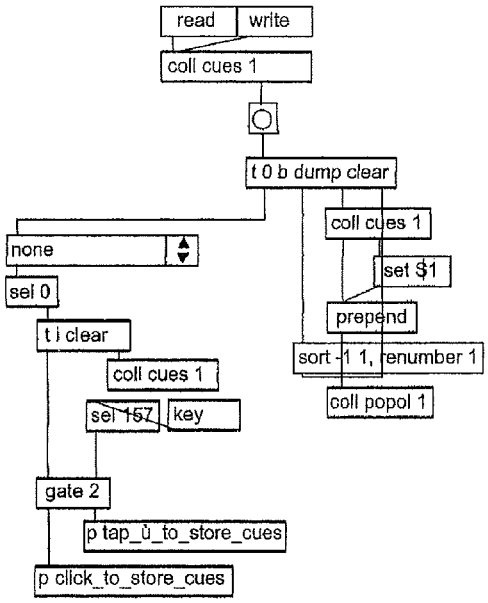
FIG. 11 represents a detail of FIG. 10 which shows the rhythm control points desired by a user of a device for controlling the running of an audio file.

Bottom left there is a part, represented in FIG. 11, that can be used to create a table containing the list of rhythm control points desired by the person: on listening to the piece, he taps on a key at each instant that he wants to tap in the subsequent interpretation. Alternatively, these instants may be designated by the mouse on the wave form. Finally, they can be edited.

Figure 12:
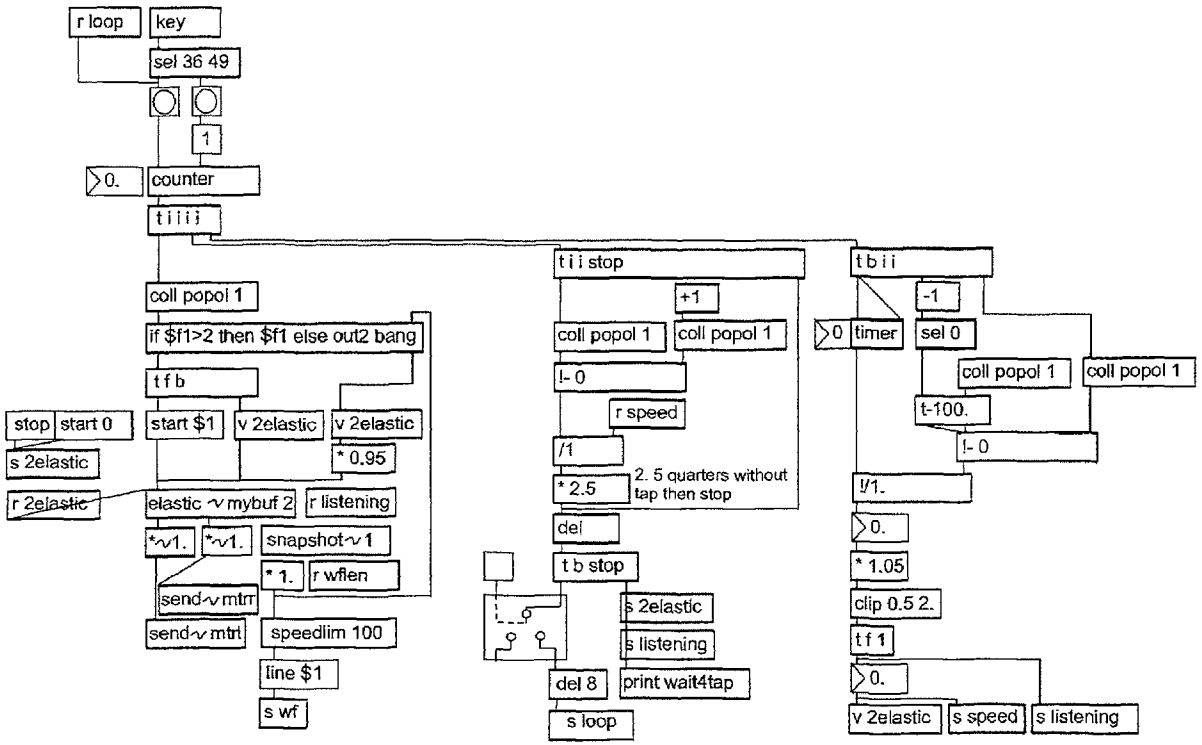
FIG. 12 represents an expanded flow diagram of a method for controlling the timing of the running of an audio file.

FIG. 12 details the part of FIG. 10 located bottom right which represents the timing control which is applied.

In the column on the right, the acceleration/slowing down coefficient SF is computed by comparison between the duration that exists between two consecutive markers, on the one hand in the original piece and on the other hand in the actual playing of the user. The formula for computing this speed factor is given above in the description.

In the central column, a timeout is set that makes it possible to stop the running of the audio if the user has not performed any more strikes for a time dependent on the current musical content.

The left-hand column contains the core of the control system. It relies on a time compression/expansion algorithm. The difficulty lies in transforming a "discrete" control, therefore one occurring at consecutive instants, into an even modulation of the speed. By default, the listening suffers on the one hand from total interruptions of the sound (when the player slows down), and on the other hand from clicks and sudden jumps when he speeds up. These defects, which make such an approach unrealistic because of a musically unsable audio output, are resolved in the embodiment implementation developed. It includes:

never stopping the sound track even in the event of a substantial slowing down on the part of the user. The "if" object of the left-hand column detects whether the current phase is a slowing-down or a speeding-up phase. In the slowing-down case, the playback speed of the algorithm is modified, but there is no jump in the audio file. The new playback speed is not necessarily exactly the one computed in the right-hand column (SF), but can be corrected (speed factor CSF) to take account of the fact that the marker corresponding to the last action of the player has already been overtaken in the audio;

performing a jump in the audio file on an acceleration (second branch of the "if" object). In this precise case, this has little subjective impact on the listening, if the control markers correspond to musical instants that are psycho-acoustically sufficiently important (there is here a parallel to be made with the basis of the MP3 compression, which poorly codes the insignificant frequencies, and richly codes the predominant frequencies). We are talking here about the macroscopic time domain; certain instants in listening to a piece are more meaningful than others, and it is on these instants that you want to be able to act.

The examples described above are given as a way of illustrating embodiments of the invention. They in no way limit the scope of the invention which is defined by the following claims.

The invention claimed is:

1. A device for interpreting gestures of a user comprising:

at least one input module for measurements comprising at least one motion capture assembly on at least a first and a second axis, a module for processing signals sampled at an output of the input module, and an output module capable of playing back a musical meaning of said gestures, the signal processing module comprising a submodule for analyzing and interpreting the gestures comprising a filtering function, a function for detecting the gestures by comparison of a variation between at least two successive values in the sample of at least one of the signals originating from at least the first axis of the set of sensors with at least a first selected threshold value and a function for confirming the detection of a gesture, wherein said function for confirming the detection of a gesture is capable of comparing at least one of the signals originating from at least the second axis of the set of sensors with at least a second selected threshold value.

2. The device for interpreting gestures of claim 1, wherein the filtering function is executable by at least one pair of two successive low-pass recursive filters configured to receive as input at least one of the signals output from the module.

3. The device for interpreting gestures of claim 2, wherein the function for detecting the gestures is configured to identify changes of sign between two successive values in the sample of the difference between at least one output from the first filter of at least one of the pairs of filters at a current value and at least one output from the second filter of the same pair of filters for the same signal at a preceding value.

4. The device for interpreting gestures of claim 3, wherein the submodule for analyzing and interpreting the gestures also comprises a function for measuring a velocity of the gesture detected at the output of the detection confirmation function.

5. The device for interpreting gestures of claim 4, wherein the function for measuring velocity is capable of computing a travel (Max-Min) between two detected gestures.

6. The device for interpreting gestures of claim 3, wherein the second filter is capable of operating at a cut-off frequency less than that of the first filter.

7. The device for interpreting gestures of claim 2, wherein the input module comprises at least a first sensor comprising an accelerometer and a second sensor comprising a magnetometer or a rate gyro.

8. The device for interpreting gestures of claim 7, wherein the function for detecting the gestures is capable of receiving as input at least one output from a second recursive filter of one of the pairs of filters applied to at least one of the signals from the first sensor.

9. The device for interpreting gestures of claim 7, wherein the function for confirming the detection of a gesture is capable of receiving as input at least one output from a second recursive filter of one of the pairs of filters applied to at least one of the signals from the second sensor.

10. The device for interpreting gestures of claim 9, wherein the threshold selected for the function for confirming the detection of a gesture is of the order of 5/1000 as a relative value of the filtered signal.

11. The device for interpreting gestures of claim 4, wherein the input module receives the signals from at least two sensors positioned on two independent parts of the body of the user, a first sensor supplying, via one of the pairs of recursive filters, a signal as input for the function for detecting the gestures and a second sensor supplying, via one of the pairs of recursive filters, a signal as input for the function for measuring the velocity of the gesture detected at the output of the function for confirming the detection of a gesture.

12. The device for interpreting gestures of claim 1, wherein the signal processing module comprises an input submodule for prerecorded multimedia content.

13. The device for interpreting gestures of claim 12, wherein the input submodule for multimedia contents comprises a function for partitioning said multimedia content into time windows that can be used to perform a second confirmation of detection of the detected gestures.

14. The device for interpreting gestures of claim 1, wherein the input module is capable of transmitting to the processing module a signal representative of a position of the user in a plane substantially orthogonal to a direction of the detected gesture to perform a second confirmation thereof.

15. The device for interpreting gestures of claim 1, wherein the output module comprises a submodule for playing back a prerecorded file of signals to be played back and the processing module comprises a submodule for controlling a timing of said prerecorded signals, said playback submodule being able to be programmed to determine times at which strikes controlling a runrate of the file are expected, and said timing control submodule is capable of computing, for a certain number of control strikes, a relative corrected speed factor of preprogrammed strikes in the playback submodule and strikes actually entered in the timing control submodule and a relative intensity factor of velocities of said strikes actually entered and expected then of adjusting the runrate of said timing control submodule to adjust said corrected speed factor on subsequent strikes to a selected value and intensities of the signals output from said playback submodule according to said relative intensity factor of the velocities.

16. The device of claim 15, wherein the velocity of the entered strike is computed on the basis of a deviation of the signal output from the second sensor.

17. The device for interpreting gestures of claim 15, wherein the input module also comprises a submodule capable of interpreting gestures of the user whose output is used by the timing control submodule to control a characteristic of the audio output selected from the group consisting of vibrato and tremolo.

18. The device for interpreting gestures of claim 15, wherein the playback submodule comprises a function for placing tags in the file of prerecorded signals to be played back at times at which strikes controlling the runrate of the file are expected, said tags being generated automatically according to the rate of the prerecorded signals and being able to be shifted by a MIDI interface.

19. The device for interpreting gestures of claim 15, wherein the value selected in the timing control submodule to adjust the running speed of the playback submodule is equal to a value selected from a set of computed values of which one of the limits is computed by application of a corrected speed factor equal to the ratio of the time interval between the next tag and the preceding tag minus the time interval between the current strike and the preceding strike to the time interval between the current strike and the preceding strike and whose other values are computed by linear interpolation between the current value and the value corresponding to that of the limit used for the application of the corrected speed factor.

20. The device for interpreting gestures of claim 19, wherein the value selected in the timing control submodule to adjust the running speed of the playback submodule is equal to the value corresponding to that of the limit used for the application of the corrected speed factor.

21. A method for interpreting gestures of a user comprising at least one step for inputting measurements originating from at least one motion capture assembly along at least a first and a second axis, a step for processing signals sampled at an output of the input step and an output step capable of playing back a musical meaning of said gestures, the signal processing step comprising a substep for analyzing and interpreting gestures comprising at least one filtering step, a function for detecting the gestures by comparison of a variation between two successive values in the sample of at least one of the signals originating from at least the first axis of the set of sensors with at least a first selected threshold value and a function for confirming the detection of a gesture, wherein said function for confirming the detection of a gesture is capable of comparing at least one of the signals originating from at least the second axis of the set of sensors with at least a second selected threshold value.

22. The method for interpreting gestures of claim 21, wherein the output step comprises a substep for playing back a prerecorded file of signals to be played back and in that the processing step comprises a substep for controlling a timing of said prerecorded signals, said playback substep being capable of determining times at which strikes controlling a runrate of the file are expected, and said timing control substep being capable of computing, for a certain number of control strikes, a relative corrected speed factor of preprogrammed strikes in the playback substep and of strikes actually entered during the timing control substep and a relative intensity factor of velocities of said strikes actually entered and expected then of adjusting the runrate of said prerecorded file to adjust said corrected speed factor on subsequent strikes to a selected value and intensities of the signals output from the playback step according to said relative intensity factor of the velocities.

* * * * *